United States Patent [19]

Cleveland

[11] 4,153,961

[45] May 15, 1979

[54] METHOD AND APPARATUS FOR RANDOMLY DYEING TEXTILE YARNS IN A CONTINUOUS SYSTEM

[76] Inventor: J. B. Cleveland, P.O. Box 875, Calhoun, Ga. 30701

[21] Appl. No.: 852,975

[22] Filed: Nov. 18, 1977

[51] Int. Cl.[2] ..... D06B 1/02

[52] U.S. Cl. ..... 8/149; 8/151.2; 8/155; 68/205 R

[58] Field of Search ..... 8/149, 151.2, 155; 68/205 R, 200

[56] References Cited

U.S. PATENT DOCUMENTS

| | | | |
|---|---|---|---|
| 2,182,752 | 12/1939 | Janes | 68/205 R |
| 2,199,093 | 4/1940 | Wolfenden | 68/200 |
| 3,620,662 | 11/1971 | Miyamoto et al. | 68/205 R X |
| 3,650,674 | 3/1972 | Newton | 68/205 R X |
| 3,688,530 | 9/1972 | Harris et al. | 68/205 R |
| 4,005,590 | 2/1977 | McLean | 68/205 R X |

FOREIGN PATENT DOCUMENTS

| | | | |
|---|---|---|---|
| 2069 | 1/1972 | Japan | 8/149 |

*Primary Examiner*—Philip R. Coe

*Attorney, Agent, or Firm*—Cameron, Kerkam, Sutton, Stowell & Stowell

[57] ABSTRACT

Multiple strands of undyed yarn are fed continuously from supply spools or bobbins supported on a creel to a skein winding apparatus. The strands each pass along a substantially horizontal path through one or more spaced dyeing stations where they are engaged by an oscillating frame and caused to oscillate laterally back and forth from said paths while streams of dye individual to the yarns are continuously directed onto the yarns from a series of overhead tubes at the dyeing stations. The strands thus periodically interrupt the dye stream of the associated tubes and receive dye at a multiplicity of spaced portions along their lengths with intervening portions of the yarns remaining uncolored. The space dyeing can be varied by changing the speed of movement of the yarns, by varying the amplitude and speed of movement of yarn guide means which produces the lateral oscillation of the yarns and by selectively operating varying numbers of dye stream feeders at one or both dyeing stations. Upon completion of the space dyeing operation, the individual skeins of yarn can be batch dyed in an overcolor.

42 Claims, 11 Drawing Figures

FIG. 1.
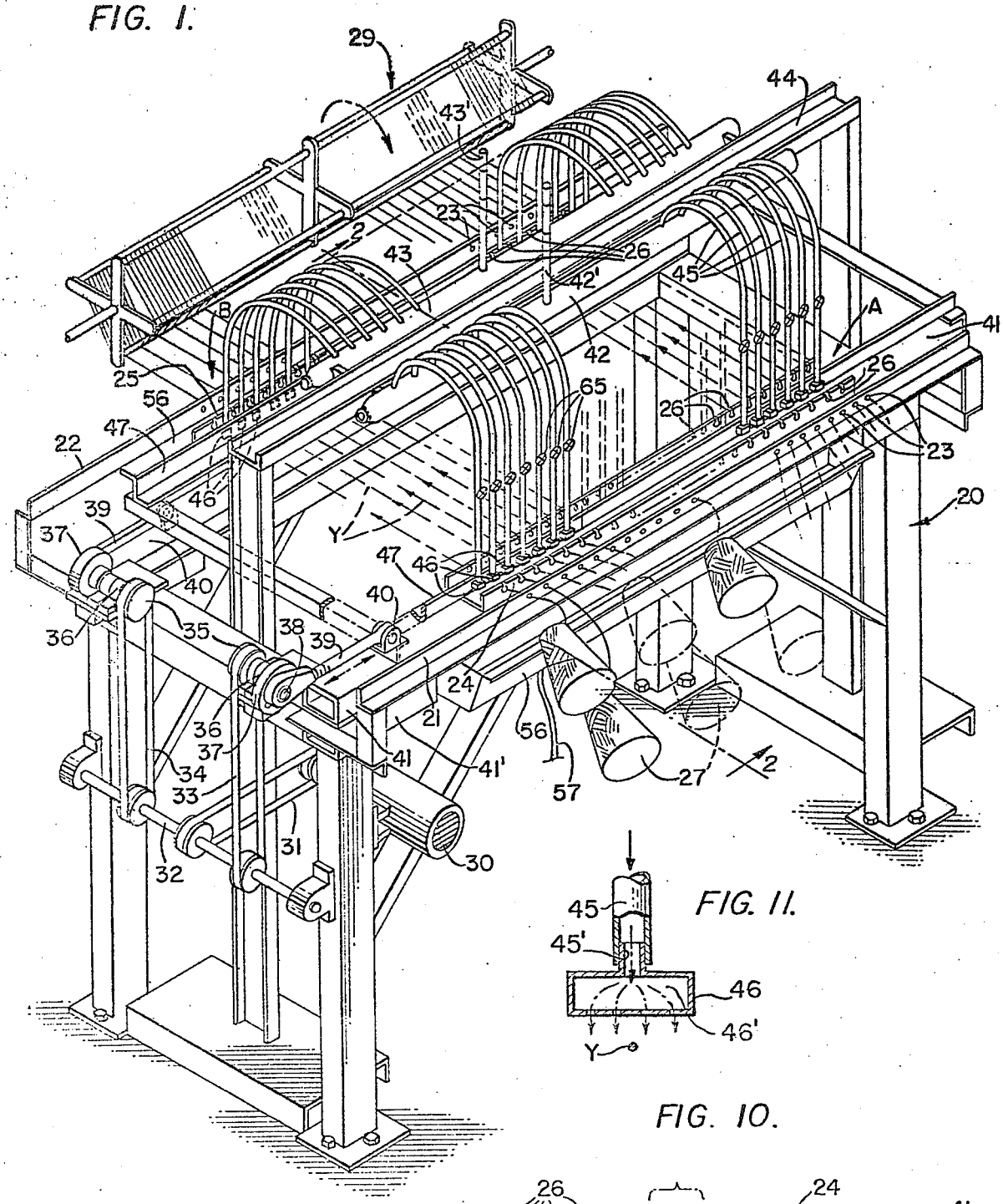
FIG. 11.
FIG. 10.
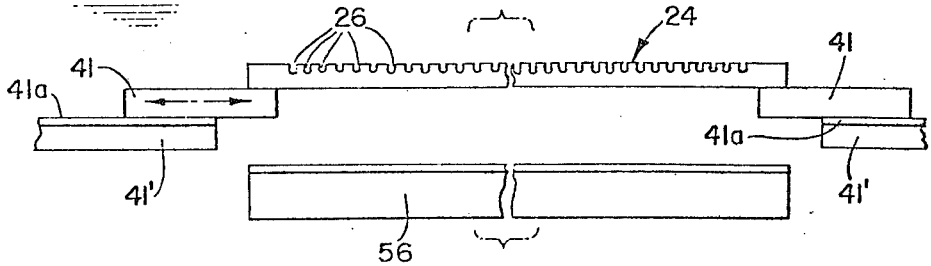

METHOD AND APPARATUS FOR RANDOMLY DYEING TEXTILE YARNS IN A CONTINUOUS SYSTEM

BACKGROUND OF THE INVENTION

There are currently at least four commercial systems being used to space dye yarns used to fabricate multicolor carpets. These four systems may be divided into two basic classifications known as continuous systems and batch systems.

One of the two continuous systems used in the textile industry is the knit-de-knit space dyeing process which is generally described in U.S. Pat. No. 3,012,303, issued Dec. 12, 1961, to Ralph Whitaker. This process consists of six basic steps. The yarn is first knitted into a fabric after which a stripe or other pattern is printed on the knitted fabric. The color is set by steam color fixation of the knitted fabric which is then scoured to remove gums and excess dyes. After the knitted fabric is dried, the final step includes de-knitting of the knitted fabric to a cone of yarn.

The other of the continuous systems is generally known as warp printing. It also involves six basic steps including preparation of warp sheets (creeling) and thereafter application of a stripe or pattern which is printed on the warp sheet. The color is set by steam color fixation of the warp sheet which is then scoured to remove gums and excess dyes. After the warp sheet is dried, it is split and the yarns rewound onto cones.

Both types of the continuous systems suffer from similar disadvantages in that they require high levels of water consumption and expensive water treatment to remove pollutants. Costs of operation are high due to wasted energy in atmospheric steaming, continuous drying and high labor requirements.

The two batch systems in commercial use are injection dyeing and skein dyeing. Injection dyeing processes have been known for over a half of a century. Still, injection dyeing accounts for only a small portion of the textile yarn being dyed into multi-colors. A typical process for injection dyeing is described in U.S. Pat. No. 1,726,984 to Louis Hasbrouck, dated Sept. 3, 1929. Another injection dyeing process is disclosed in U.S. Pat. No. 3,120,422, dated Feb. 4, 1964. Both of these patents cover dyeing of one cone at a time with the use of hypodermic needles inserted into the cone of yarn to apply the dyes. As hereinbefore noted, injection dyeing processes have not found a great deal of commercial acceptance.

In the other of the batch systems used in the textile industry, the yarn is first unwound from its cones or bobbins to skeins which are loaded into the vat of a dye machine. The skeins are totally submerged in a dye bath and a base color is applied. The skeins are then partially raised out of the dye bath, and may further be rotated depending on the design of the machine and a second color is applied to the portion of the yarn submerged in the dye bath. This step is repeated for each additional color desired, after which the skeins are removed from the dye machine and put into a centrifugal extractor to remove the excess water. The skeins are then dried in an oven drier after which the skein dyed yarn is rewound on cones for further processing.

A typical apparatus for space dyeing of skeins by total submersion and application of a base color and thereafter selective withdrawal or raising of the skeins to apply additional colors to the partially immersed yarn was placed in commercial production in late 1971 by James H. Eakes and is described and illustrated in his application Ser. No. 480,026, filed June 17, 1974, now abandoned. Such apparatus for producing space dyed skeins of yarns is also described and illustrated in O'-Mahony et al. U.S. Pat. Nos. 3,926,547 and 3,986,375.

For example, the supercarriers of skeins in such apparatus must be so constructed as to support the greatly increased weight of the yarn following immersion. Generally, a compromise must be accepted by operation at less than full capacity of the apparatus to prevent bending of the cantilever yarn supporting tubes. Additional problems experienced with skein dyeing are: maintaining the liquor ratio constant, high water consumption and high energy requirements. Some of the latter problems are overcome by the vat dyeing process described in my copending application Ser. No. 846,988 filed Oct. 31, 1977 and entitled Method and Apparatus For Randomly Coloring Textile Yarns In A Batch System.

Multi-color or space dyed yarn has experienced a high degree of popularity among carpet manufacturers who continually strive for materials which enable them to meet the demands for continuous changes in styling and an objective of this invention is to provide a much more economical, practical and convenient method and apparatus for the space dyeing of yarns.

More particularly, it is an objective of the invention to provide a continuous process for space dyeing yarns which economizes on the consumption of water and energy while utilizing a comparatively simple and inexpensive apparatus.

Another objective is to provide a continuous process for space dyeing yarns which avoids the drawbacks of the prior art knit-de-knit, warp printing processes and vat dyeing processes.

Other objectives and advantages of the invention will become apparent during the course of the following description.

SUMMARY OF THE INVENTION

A multiplicity of yarns are continuously fed in spaced relationship from yarn supply bobbins to a skein winding mechanism. During their movements, the yarns are engaged at two separated dyeing stations by reciprocating guide devices which cause the yarns to deviate or oscillate back and forth laterally at the two stations from their primary longitudinal paths of movement. At the two dyeing stations and while the yarns are oscillated back and forth, multiple dye streams from overhead banks of dye feeder tubes are directed onto the moving yarns. Each dye tube is positioned such that its dye stream or streams, as the case may be, intersects the primary path of movement of and associated strand of yarn. As a result of this, the continuous dye streams impinge on the yarns. at longitudinally spaced portions therealong, leaving intervening portions of the yarns undyed. The spacing of the dyed and undyed regions on the yarns can be varied by changing the transport speed of the yarns, the amplitude and speed of the reciprocating yarn guide means, and by selectively operating varying numbers of dye feeder tubes in one or both banks of tubes.

A complete system embodying the invention comprises continuously transporting the spaced yarns from their supply bobbins to the skein winding mechanism while space dyeing the yarns in the above-described manner, followed by steam fixing of the dye in the space dyed skeins, and then overdyeing the skeins in a vat type batch dyer, followed by additional conventional fixing, washing and liquid expelling steps.

BRIEF DESCRIPTION OF THE DRAWINGS

FIG. 1 is a perspective view of a yarn space dyeing apparatus employed in the practice of the method.

FIG. 10 is a fragmentary side elevation of a reciprocating yarn guide and support means.

FIG. 11 is a fragmentary side elevation and cross sectional view of the end of a dye tube terminating at an adapter for splitting an individual dye stream into a plurality of streams.

DETAILED DESCRIPTION

Figure 2:
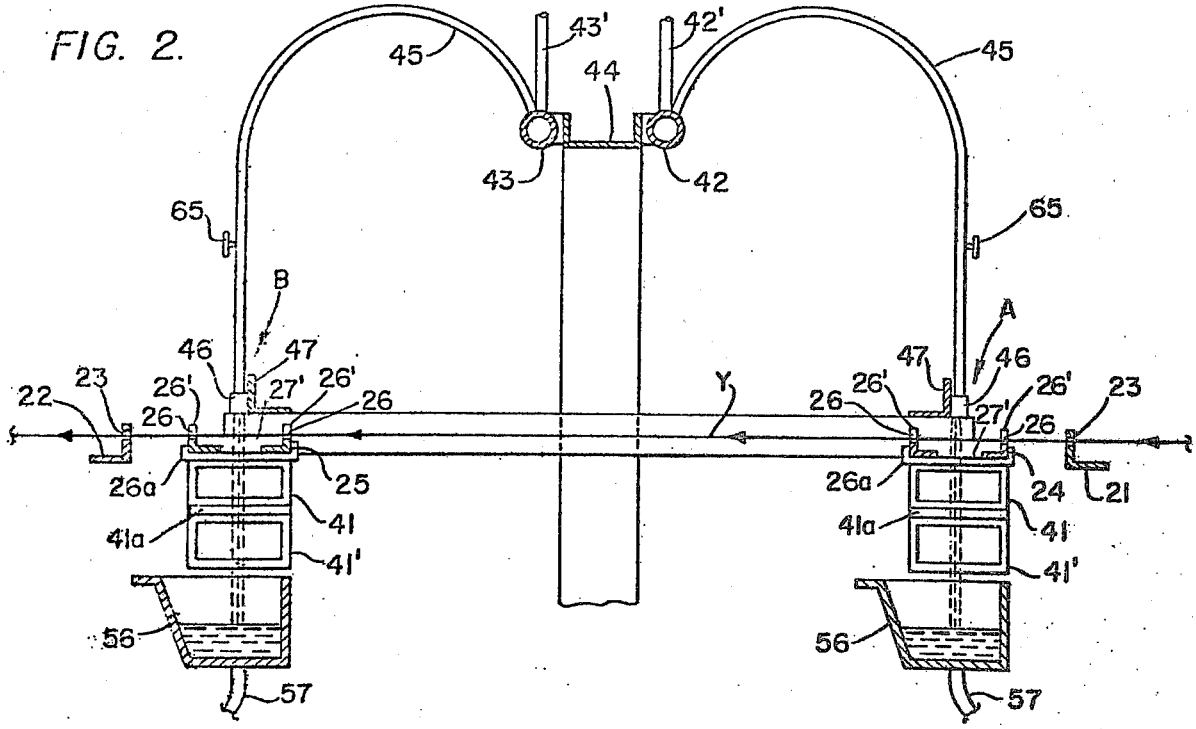
FIG. 2 is an enlarged vertical section taken on line 2—2 of FIG. 1.

Referring to the drawings in detail wherein like numerals designate like parts, a space dyeing apparatus employed in the practice of a yarn dyeing method is shown in FIG. 1 and comprises a support frame 20 on which are mounted first and second fixed vertical guide plates 21 and 22 in spaced parallel relation, each plate having a multiplicity of equidistantly spaced yarn guide apertures 23 formed therethrough.

Slightly downstream from the fixed guide plate 21, in relation to the direction of movement of the yarns, and slightly upstream from the guide plate 22 are first and second yarn guides 24 and 25 or channels which extend transversely of the yarns and parallel to the fixed guide plates 21 and 22. Each yarn guide is formed by a pair of spaced opposed parallel angle bars 26', see FIG. 2, rigidly interconnected near their ends by cross brackets 26*a* or by other suitable means. Continuous slots 27', for a purpose to be described, are formed between the angle bars 26' of each guide 24 and 25. The vertical webs of the angle bars 26' have top opening slots 26 formed therein in the same spaced relationship as the apertures 23 of the fixed plates 21 and 22. The slots 26 receive and guide individual yarns being transported through the apparatus at right angles to the guides 24 and 25, as will be further described.

Figure 9:
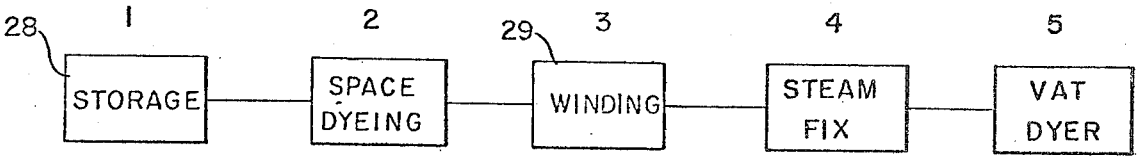
FIG. 9 is a block diagram of a complete yarn dyeing system embodying the invention.

As shown in FIG. 1, multiple yarns Y, preferably corresponding in number to the guide apertures 23 and slots 26, are drawn from bobbins or cones 27 of a conventional creel 28, FIG. 9, by the operation of a conventional skein winding mechanism 29 at the downstream end of the space dyeing apparatus. The individual yarns Y are threaded through the fixed guide apertures 23 of both guide plates 21 and 22 and are engaged within the slots 26 of the guides 24 and 25, as best shown in FIG. 2.

Means are provided to simultaneously reciprocate the guides 24 and 25 at desired rates and amplitudes of reciprocation. This means comprises a suitable drive motor 30 on the frame 20 which powers a take-off belt 31, connected with and driving a countershaft 32, which in turn drives vertical belts 33 and 34. Belts 33 and 34 are connected with the drive pulleys 35 mounted on short horizontal drive shafts held in bearings 36 on the Frame 20. The two drive shafts carry eccentrics 37, connected at 38 to oscillating drive links 39, which in turn are connected at 40 to pairs of reciprocating slides 41 at each end of the apparatus on which the guides 24 and 25 are fixedly mounted. The slides 41 for the reciprocating guides are in turn slidably mounted on short cantilever support members 41' at each side of the frame 20, the members 41' having suitable bearing pads 41*a*, FIG. 2, fixed to their top faces to reduce friction in the two reciprocating guides 24 and 25. The slides 41 of the reciprocating guides terminate slightly inwardly of the opposite ends of the paired angle bars 26' and lap the bottoms of the same for a sufficient distance only to support the angle bars firmly, as shown in FIG. 10. This arrangement allows the longitudinal slots 27' of the two reciprocating guides to be open and unobstructed throughout their lengths for the free passage of multiple dye streams downwardly therethrough, as will be further described.

The strokes of the two reciprocating yarn guides 24 and 25 composed of the elements 26' and 41 may be regulated in any conventional way, as by changing the location of the eccentric connections 38 of drive links 39. Also, the speeds of reciprocation of the two guides may be varied conventionally to render the process more versatile.

In the space dyeing apparatus, the locations of the two reciprocating yarn guides 24 and 25 and their slots 27' establish first and second dyeing stations A and B in the apparatus where multiple streams of liquid dye are delivered onto the moving yarns Y. To accomplish this, first and second dye headers 42 and 43 are fixedly mounted on an elevated extension of the apparatus frame 20 at the center of the apparatus. The two headers 42 and 43 are parallel to the yarn guiding means and substantially co-extensive lengthwise therewith, as shown. Dye stream feeder tubes 45 in two banks lead from the headers 42 and 43 and are directed downwardly in parallel spaced relationship, the feeder tubes corresponding in number and spacing to the yarn guide apertures 23 and slots 26. The lower dye discharge ends of the feeder tubes 45 terminate at the same elevation slightly above and in alignment with the slots 27' of reciprocating guides 24 and 25 at the two dyeing stations A and B of the apparatus. The lower or delivery ends of the dye streams exiting from the feeder tubes are preferably arranged to feed into individual adapters 46 associated with each tube which serve to break up the individual dye streams flowing through the tubes into one or more dye streams. To this end, as shown in FIG. 11, each adapter 46 includes one or more outlet apertures 46' in its lowermost wall and an upwardly extending inlet nipple 45' over which the discharge end of the associated tube 45 is anchored. Advantageously, tubes 45 may be of soft plastic material of a diameter equal to or slightly less than the outside diameter of nipple 45'. This enables a tube 45 to be stretched in a tight sealing engagement with the associated nipple 45'. If desired, suitable hose clamps may be used to ensure a tight seal or tube 45 may be fabricated of metallic material and provided with internal threads or a threaded fitting for threaded engagement with mating threads provided on nipple 45. Adapters 46 are anchored to fixed frame bars 47 slightly above the guides 24 and 24, FIG. 2. The discharge ends of the adapters 46 are centered relative to the two reciprocating guides 24 and 25 and their slots so that the dye streams delivered downwardly from the tubes in the two banks are at right angles to the yarns Y, which yarns travel in a plane slightly below the discharge ends of the adapters.

Figure 8:
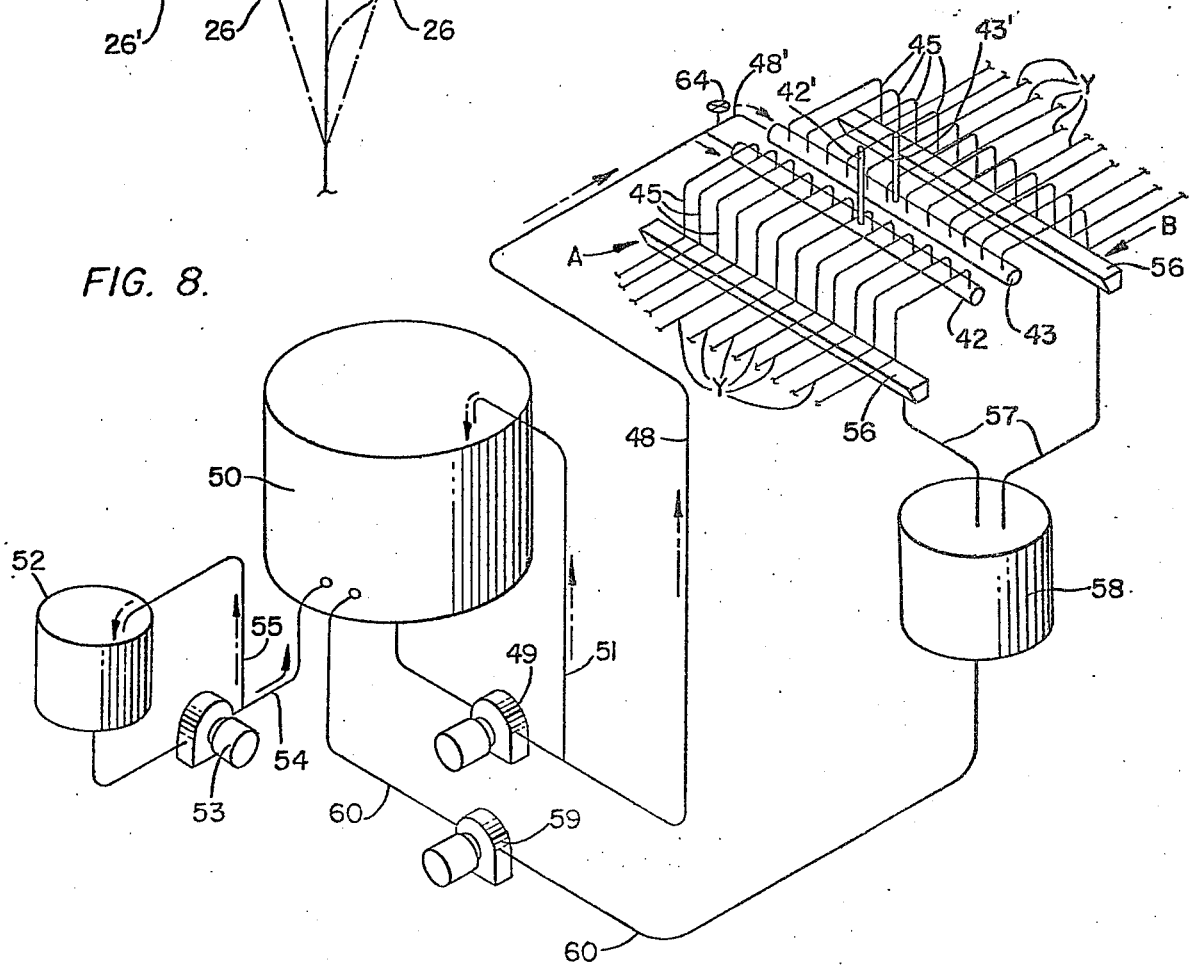
FIG. 8 is a flow diagram for the space dyeing apparatus.

Referring to FIG. 8, the dye headers 42 and 43 are continuously supplied with dye through a conduit 48–48', fed by a pump 49 which receives dye from a dye mixer 50. An overflow conduit 51 connected in conduit 48 downstream from the pump 49 returns excess dye to the mixer 50. Powdered dye is dissolved in tank 52 and is delivered by pump 53 and line 54 into mixer 50—and a recirculating line 55 connected in line 54 allows the dissolved powdered dye to be recirculated to insure proper dye solution. A pair of excess dye recovery troughs 56 positioned below the slots 27' of reciprocating guides 24 and 25 at the two dyeing stations A and B collect and return excess dye from the tubes 45 through return conduits 57 to a holding tank 58, from which another pump 59 moves the dye through a return line 60 back to the dye mixer 50.

Figure 3:
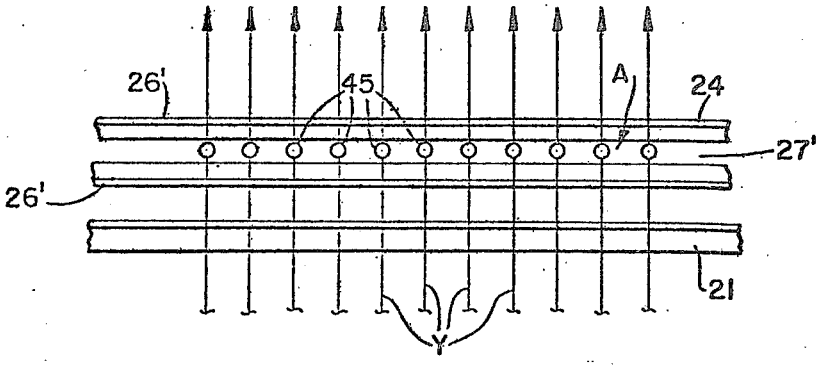
FIGS. 3, 4 and 5 are partly schematic plan views showing stationary and reciprocating yarn guides which cause the yarns to deviate laterally from their main paths of travel at the dyeing stations.
Figure 4:
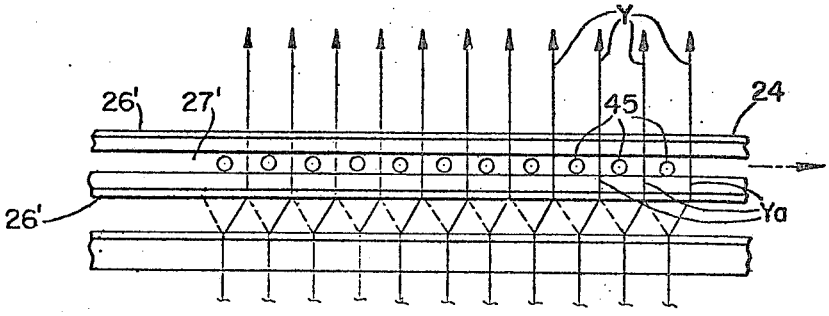
Figure 5:
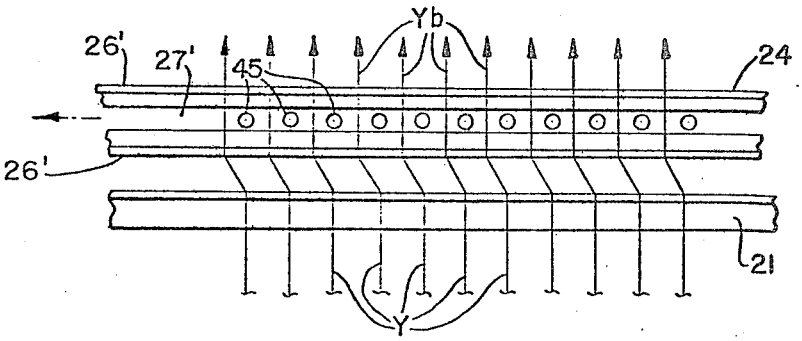

The operation of the apparatus in the practice of the yarn space dyeing method is best understood by reference to FIGS. 3 through 6. FIGS. 3 to 5 show the constantly changing relationship of the moving web of yarns Y to the fixed dye stream delivery tubes 45 caused by reciprocation of the guides 24 and 25 across the primary paths of movements of the yarns at dyeing stations A and B. FIG. 3 shows the reciprocating slotted yarn guide 24 at the median position where the yarns Y are directly under the discharge ends of tubes 45 and therefore intersecting the associated dye streams traveling downwardly from the tubes.

FIG. 4 shows the reciprocating guide 24 shifting the yarns laterally to one side of the fixed tubes 45 as at $Y_a$, with the yarns out of alignment with the tubes and thus escaping the action of the dye stream, as the yarns continue to advance through the apparatus. At this time, the dye streams simply pass through the slots 27' and into the recovery troughs 56 at the two dyeing stations without effecting any dyeing of yarns.

FIG. 5 shows a condition similar to FIG. 4, except that the yarns Y are shifted by the guide 24 laterally beyond the other sides of the fixed tubes 45 so that the yarns are again escaping the dye streams while continuing to travel through the apparatus toward the skein builder 29.

For purposes of illustration and simplification, the dye streams are represented as exiting from the dye tubes 45. In actual practice, the dye stream exits from an adapter 46 (FIG. 11). If adapter 46 contains a single opening, the resultant dye stream is directly over the yarn in the median position. Where adapter 46 contains two or more openings, the resultant dye streams may be displaced from the medium position; however, the breadth of the multiple dye streams from an adapter is such that at maximum lateral movement of the yarn in either direction, the yarn is beyond the fall of the associated dye streams as shown in FIGS. 4 and 5.

In shifting from their positions in FIG. 4 to those shown in FIG. 5, it will be understood that the yarns Y in the web of yarns again pass through the median position shown in FIG. 3 and in doing so, again intersect the dye streams which are constantly delivered from the tubes 45. Thus, the yarns are again dyed at localized points. This continuous back and forth deviation or lateral shifting of the yarns on opposite sides of their primary paths of travel caused by the reciprocating guides 24 and 25 at the two dyeing stations is rapid and repetitive, and as a result, all of the yarns Y are randomly dyed or space dyed at a multiplicity of localized regions shown at 61 in FIG. 7 with the intervening regions 62 of the yarns remaining undyed, as these are the regions which escaped the dye streams from the tubes 45 with the yarns in the shifted positions of FIGS. 4 and 5.

Figure 6:
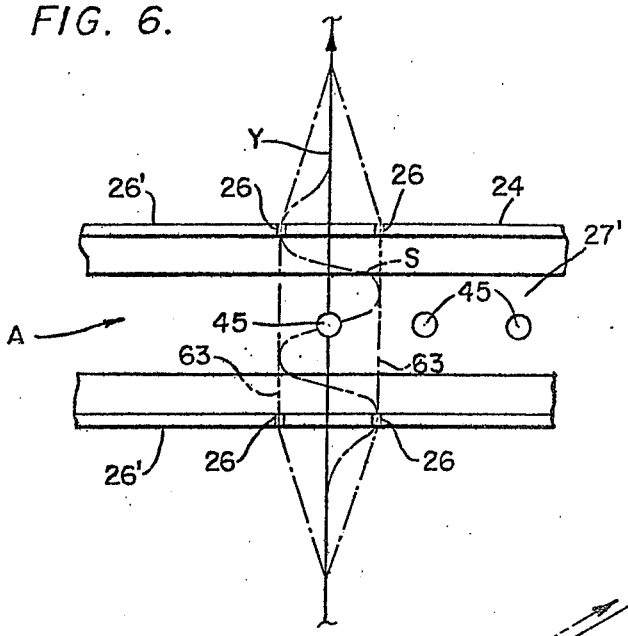
FIG. 6 is an enlarged schematic view showing the sinusoidal path of movement of one point on each yarn at each dyeing station.

FIG. 6 illustrates that during the simultaneous longitudinal and transverse movements of the yarns at dyeing stations A and B a given point on each yarn Y follows a sinusoidal path S while traveling beneath the tubes 45. Broken lines 63 in FIG. 6 denote the limits of the back and forth stroke of each reciprocating guide 24 and 25. Depending on the length of this stroke and the transport speed of the yarns, the yarns may deviate laterally back and forth on the sinusoidal paths several times at each dyeing station as graphically illustrated in FIG. 6.

Figure 7:
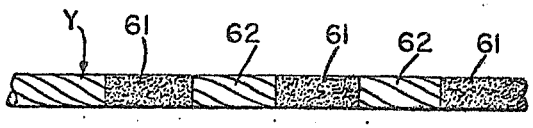
FIG. 7 is an enlarged fragmentary elevational view of a section of yarn after space dyeing in accordance with the invention.

As previously noted, the process is versatile and the space dyeing of yarns may be widely varied in the process to change the spacing of the colored and uncolored zones 61 and 62, FIG. 7. For example, the transport speed of the yarns through the apparatus can be adjusted, a typical linear speed being about 400 yards per minute as the yarns travel between the supply cones 27 and skein builder 29. The reciprocation strokes of the guides 24 and 25 may be varied, a typical stroke being one inch and a typical rate of reciprocation being about 180 strokes per minute. Also, the apparatus may operate with only one dye header 42 active and with the other header shut off by closing the valve 64 shown in FIG. 8 which is connected in the conduit 48'. Similarly, during the operation of one or both of the headers 42 and 43, selected numbers of dye feeder tubes 45 in one or both banks may be operated while other selected tubes are shut off by closing valves 65 provided therein. Thus, a variety of space dyeing patterns can be obtained in the process.

If the dye pump 49 is an expensive metered pump, the two headers 42 and 43 can be maintained full of dye at all times and equal volumes of dye will be discharged through all of the tubes 45. Alternatively, as illustrated, where a less expensive pump 49 is employed in the apparatus, a pair of upstanding sight tubes 42' and 43' may be provided on the headers 42 and 43 near their centers to form small overflow reservoirs and to also serve as sight tubes or gages. As long as the tubes 42' and 43' contain liquid dye above the level of the headers 42 and 43, the operator of the process is assured that the headers are full and equal streams of dye are being delivered from all of the tubes 45 in the two banks of tubes at dyeing stations A and B. The arrangement dispenses with the necessity for a more expensive metered pump in the system.

FIG. 9 is a block diagram of a complete yarn dyeing system including the space dyeing apparatus and process herein as a part thereof. The described space dyeing process in FIG. 9 is illustrated by the block numbered 2. Ahead of this block, the creel for bobbins or cones 27 is shown in block 1 at 28 while the skein builder 29 is shown in block 3. The usual batch steamer to fix the dye in the space dyed skeins is indicated at block 4, and at block 5 of the diagram the space dyed skeins are over-dyed in any desired shade in a batch dyeing vat, followed by other conventional treatment dye fixing and washing steps, not shown. Suitable apparatus for vat dyeing and treatment may take the form shown in U.S. Pat. No. 1,911,305, the aforementioned abandoned application Ser. No. 480,026 of James Eakes, U.S. Pat. No. 3,926,547 or my aforementioned application Ser. No. 846,988 or any conventional batch skein dyeing apparatus.

The continuous space dyeing process forming the main subject matter of the invention is fast and economical and free of the drawbacks present in the prior art which were discussed in the introduction to the application. Notably, the invention economizes the use of water and energy compared to the prior art.

It is to be understood that the form of the invention herewith shown and described is to be taken as a preferred example of the same, and that various changes in the shape, size and arrangement of parts may be restored to, without departing from the spirit of the invention or scope of the subjoined claims.

I claim:

1. A process for randomly coloring textile yarns in a continuous system comprising continuously transporting a plurality of spaced yarns on parallel primary transport paths between yarn supply and take-up means, reciprocating said yarns laterally at first and second spaced points while said yarns are being transported along said transport paths to cause the yarns to deviate from the primary path at said first and second points, and directing first and second streams of dye onto said yarns at said first and second spaced points, respectively, while the yarns are reciprocated.

2. A process as set forth in claim 1, wherein said dye streams are directed by positioning the streams of dye in relation to said spaced yarns so that a stream of each said first and second streams and a yarn intersect at said points when the yarns are reciprocated.

3. A process as set forth in claim 2, wherein each said spaced yarn is caused to oscillate laterally on opposite sides of its primary transport path.

4. A process as set forth in claim 3, wherein each said yarn is caused to follow sinusoidal paths of movement in said region.

5. A process as set forth in claim 1, further including the steps of winding the randomly colored yarns into skeins and over-dyeing the skeins of yarn so wound.

6. A process as set forth in claim 1, wherein spaced yarns are caused to reciprocate back and forth laterally from said primary transport paths by engaging the yarns at adjacent and upstream of said first point and adjacent and downstream of said second point with fixed guide means and engaging the yarns on opposite sides of said first and second points and along the primary transfer paths with transversely reciprocating guide means.

7. A process as set forth in claim 1, wherein the random coloring of the yarns in said process in varied by changing the transport speeds of the yarns in relation to said back and forth lateral reciprocation of the yarns.

8. A process as set forth in claim 1, wherein the random coloring of the yarns in said process is varied by selectively changing the number and location of the streams of dye being directed onto individual yarns.

9. Apparatus for randomly dyeing yarns comprising means for continuously feeding a plurality of spaced yarns on primary transport paths, means for engaging the yarn while they are moving along said transport paths including a first stationary yarn guide member and a first coacting transverse reciprocating guide member for shifting the yarns back and forth laterally of said transport paths in at least one region, said reciprocating guide member including spaced walls having guide openings for the yarns so that localized portions of the yarns are held by the reciprocating guide member in spaced parallel relationship during reciprocation of the guide member, and at least one bank of transversely spaced dye feeder tubes supported above the reciprocating guide member for directing streams of dye onto the individual yarns in said region while the yarns are being shifted back and forth laterally.

10. Apparatus for randomly dyeing yarns as set forth in claim 9, wherein said bank of spaced dye feeder tubes is disposed above said yarns with the axes of said tubes fixed to intersect the primary transport paths of the yarns.

11. Apparatus for randomly dyeing yarns as set forth in claim 9, wherein the tubes of said bank are valved for selective operation.

12. Apparatus for randomly dyeing yarns as set forth in claim 9, wherein the means for directing streams of dye onto the individual yarns comprises two banks of spaced dye feeder tubes disposed along first and second planes and at spaced points along said primary transport paths with the axes of the tubes in the banks positioned to intersect the primary transport paths, and the means for engaging the yarns and shifting the yarns back and forth laterally includes a second yarn guide member and a second coacting transverse reciprocating guide member, said first and said second member being disposed at spaced regions along said transport path and adjacent said banks of dye stream delivery tubes.

13. Apparatus for randomly dyeing yarns as set forth in claim 12, including means for continuously supplying the feeder tubes of said banks with dye, said means comprising a first and a second header, said feeder tubes having inlet ends and outlet ends, said first header being connected with the dye inlet ends of the tubes in one of said banks and said second header being connected with the dye inlet ends of the tubes in the other of said banks and delivery pump means connected with the headers.

14. Apparatus for randomly dyeing yarns as set forth in claim 13, including valve means operatively connected to the delivery pump means to allow selective operation of one or both of said headers.

15. Apparatus for randomly dyeing yarns as set forth in claim 9, wherein said means for continuously feeding the spaced yarns comprises yarn creel means near the upstream end of the apparatus and coacting yarn skein winding means near the downstream end of the apparatus.

16. Apparatus for randomly dyeing yarns as set forth in claim 9, including excess dye recovery means adjacent to the reciprocating guide member.

17. Apparatus for randomly dyeing yarns as set forth in claim 16, wherein said reciprocating guide member includes a longitudinal slot aligned with said dye feeder tubes and said dye recovery means comprises a trough disposed below the reciprocating guide member and aligned with said slot.

18. A process as set forth in claim 1, including the additional step of recovering and recirculating excess dye from said streams of dye in the process.

19. A process as set forth in claim 1, wherein said dye streams are directed onto said spaced yarns by gravity.

20. A process as set forth in claim 19, wherein said spaced yarns are caused to shift laterally on opposite sides of primary transport paths between said yarn supply means and said take-up means.

21. A process for randomly coloring textile yarns in a continuous system comprising continuously transporting a plurality of spaced yarns along substantially horizontal parallel transport paths between yarn supply and take-up means, reciprocating said yarns laterally at a plurality of locations spaced along the transport path between said yarn supply means and take-up means while they are moving on said transport paths and directing streams of dye onto regions of individual yarns at each said location while the yarns are reciprocated and transported.

22. A process as set forth in claim 21, wherein said dye streams are selectively directed onto spaced regions of the yarns along the transport path by controlling the speed of transport of the yarns relative to the speed of reciprocation.

23. A process as set forth in claim 21, wherein said spaced yarns are reciprocated by engaging the yarns with fixed guide means adjacent each said first and second location while they are being transported along said transport paths and engaging the yarns upstream and adjacent said first guide means and downstream and adjacent said second guide means with transversely reciprocating guide means to cause the yarns to be displaced back and forth laterally in plural localized regions, and said streams of dye are directed onto the individual yarns in said plural regions while the yarns are displaced laterally.

24. A process as set forth in claim 23, further including the winding the yarns into skeins and steps of overdyeing the skeins of yarn so wound.

25. A process as set forth in claim 24, wherein the random coloring of the yarns in said process is varied by changing the transport speeds of the yarns in relation to said back and forth lateral reciprocation of the yarns.

26. A process as set forth in claim 24, wherein the random coloring of the yarns in said process is varied by selectively changing the number and location of the streams of dye being directed onto an individual yarn along the primary transport path.

27. Apparatus for randomly dyeing yarns comprising means for continuously feeding a plurality of spaced yarns on primary transport paths in a substantially horizontal plane, reciprocating guide means for shifting the yarns in said horizontal plane back and forth laterally of said primary transport paths, and spaced dye feeder means for directing streams of dye onto the individual yarns of said web while the yarns are being shifted back and forth laterally including a first and a second bank of dye stream delivery tubes positioned at spaced points along said primary transport paths with the axes of the tubes in the banks positioned to intersect the primary transport paths, guide means for engaging the yarns while they are being transported and shifted back and forth laterally of said primary transport paths and said reciprocating means including spaced walls having guide openings for the yarns so that localized portions of the yarns are held by the reciprocating guide member in spaced parallel relationship during reciprocation.

28. Apparatus for randomly dyeing yarns as set forth in claim 27, wherein said means for directing streams of dye onto the individual yarns comprises a first and a second bank of dye stream delivery tubes disposed above said horizontal plane with the axes of said tubes set to intersect the primary transport paths of associated yarns.

29. Apparatus for randomly dyeing yarns as set forth in claim 28, wherein the tubes of each said banks are valved for selective operation.

30. Apparatus for randomly dyeing yarns as set forth in claim 28 further including adapter means supported at the discharge end of said dye tubes for receiving the dye streams exiting from said dye tubes and breaking up said dye streams into at least one further stream.

31. Apparatus for randomly dyeing yarns as set forth in claim 27, wherein said guide means for engaging the yarns comprises a stationary guide member having openings for the yarns aligned along the primary transport paths with associated guide openings of the reciprocating guide for the yarns, said reciprocating guide member being positioned upstream from the stationary guide member in the direction of movement along the primary transport path.

32. Apparatus for randomly dyeing yarns as set forth in claim 27, including excess dye recovery means positioned below and adjacent to the reciprocating guide member.

33. Apparatus for randomly dyeing yarns as set forth in claim 27, including means for continuously supplying the tubes of said banks with dye, said means comprising headers connected with the dye inlet ends of the tubes in said banks and delivery pump means connected with the headers.

34. Apparatus for randomly dyeing yarns as set forth in claim 33, including valve means connected to the delivery pump means to allow selective operation of one or both of said headers.

35. Apparatus for randomly dyeing yarns as set forth in claim 34, wherein said reciprocating guide means includes a longitudinal slot aligned with said dye feeder tubes and said dye recovery means comprises a trough below the reciprocating guide means aligned with said slot.

36. Apparatus for randomly dyeing yarns as set forth in claim 9 further including adapter means supported at the discharge end of said dye tubes for receiving the dye streams exiting from said dye tubes and breaking up said dye streams into at least one further stream.

37. Apparatus for randomly dyeing yarns comprising means for continuously feeding a plurality of spaced yarns on primary transport paths in a substantially horizontal plane, reciprocating means for shifting the yarns in said horizontal plane back and forth laterally of said primary transport paths, and means for directing streams of dye onto the individual yarns of said web while the yarns are being shifted back and forth laterally including a first and a second bank of dye stream delivery tubes at spaced points along said primary transport paths with the axes of the tubes in the banks positioned to intersect the primary transport paths, means for continuously supplying the tubes of said banks with dye, said means comprising headers connected with the dye inlet ends of the tubes in said banks and delivery pump means connected with the headers, valve means connected to the delivery pump means to allow selective operation of one or both of said headers and said recirpocating means including a first and a second reciprocable member transverse to said primary transport paths and having a longitudinal slot aligned with said first and second bank of dye delivery tubes, respectively, and dye recovery means comprising a trough below each reciprocating member and aligned with said slot.

38. Apparatus for randomly dyeing yarns as set forth in claim 37, wherein said first and second banks of dye stream delivery tubes are disposed above said horizontal plane with the axes of said tubes set to intersect the primary transport paths of associated yarns and each of said tubes of each bank is valved for selective delivery of dye.

39. Apparatus as set forth in claim 38 further including means for guiding the yarns while they are being transported and shifted back and forth laterally comprising a first and a second stationary guide member for the yarns disposed, respectively, upstream of said first and second reciprocable member.

40. Apparatus for randomly dyeing yarns as set forth in claim 39, wherein each said first and reciprocable member includes spaced walls having guide openings for the yarns so that localized portions of the yarns are held by the reciprocable members in spaced parallel relationship during reciprocation of the guide member.

41. Apparatus for randomly dyeing yarns as set forth in claim 40, including excess dye recovery means supported adjacent and below each reciprocable member.

42. Apparatus for randomly dyeing yarns as set forth in claim 37 further including adapter means supported at the discharge end of each dye stream delivery tube for receiving the dye stream exciting from the associated dye tube and breaking up said dye stream into a plurality of streams, each said yarn being arranged to pass through an associated plurality of streams as said yarn in shifted back and forth.

* * * * *